United States Patent [19]

Wakabayashi

[11] 4,428,299

[45] Jan. 31, 1984

[54] ARRANGEMENT FOR TRANSFERRING CARRIERS AT POWER LINE DISCONTINUOUS PORTION OF POWER-AND-FREE TROLLEY CONVEYOR

[75] Inventor: Takao Wakabayashi, Shinsenri-Minamimachi, Japan

[73] Assignee: Nakanishi Metal Works Co. Ltd., Osaka, Japan

[21] Appl. No.: 320,692

[22] Filed: Nov. 12, 1981

[30] Foreign Application Priority Data

May 2, 1979 [JP] Japan ..... 54-59040[U]

[51] Int. Cl.[3] ..... B61B 10/02

[52] U.S. Cl. ..... 104/172 S; 104/96; 104/91

[58] Field of Search ..... 104/96, 172 S, 172 B, 104/172 BT, 91, 172 R, 89

[56] References Cited

U.S. PATENT DOCUMENTS 3,667,399 6/1972 Czarnecki ..... 104/172 S 4,148,261 4/1979 Wakabayashi ..... 104/96

*Primary Examiner*—Robert B. Reeves
*Assistant Examiner*—Richard Mathieu
*Attorney, Agent, or Firm*—Armstrong, Nikaido, Marmelstein & Kubovcik

[57] ABSTRACT

At a power line discontinuous portion of a power-and-free trolley conveyor, a carrier is transferred from a carrier entering first power line to a second power line by being pushed by a following pusher dog from behind. The following pusher dog is restrained from disengaging from the rear free trolley by at least one endless free chain positioned immediately above and parallel to the path of the pusher dog. A pair of endless free chains can be used with the chains being reeved around sprockets to be free movable along with the engaged pusher dog, thereby avoiding wear on the pusher dog side projections. The loop of the chains extend for a distance sufficient for the front free trolley of the carrier to cross the powerline discontinuous portion of the conveyor.

1 Claim, 5 Drawing Figures

ARRANGEMENT FOR TRANSFERRING CARRIERS AT POWER LINE DISCONTINUOUS PORTION OF POWER-AND-FREE TROLLEY CONVEYOR

BACKGROUND OF THE INVENTION

The present invention relates to an arrangement for transferring carriers at a power line discontinuous portion of power-and-free trolley conveyors.

At a power line discontinuous portion of power-and-free trolley conveyors, a pusher dog restraining guide rail is usually disposed at one side of the terminal end of a carrier entering power line as disclosed, for example, in Japanese Pat. No. 820,109 having Publication No. 48-22751. When a pusher dog in engagement with a tilting dog on the front free trolley of a carrier to pull along the carrier is disengaged from the dog, another pusher dog following the dog comes into striking contact with a rear end slope of a cam mounted on the rear free trolley of the same carrier, with a side projection of the following pusher dog brought into bearing contact with the lower face of the guide rail, so that the carrier is pushed forward from behind by the propelling force of the following pusher dog. With the conventional arrangement described above, however, the frictional contact between the side projection on the pusher dog rapidly wears away the two members, rendering the carrier transferring arrangement unserviceable for a prolonged period of time. In view of the above problem, it is known to mount a roller on the forward end of the side projection on the pusher dog and to make the roller rollable on the lower face of the guide rail to reduce the wear on the members, but this arrangement involves the necessity of attaching a roller to the side projection of every pusher dog, hence very cumbersome and economically disadvantageous. The arrangement has another problem in that the roller interferes with the disengagement of the pusher dog from the tilting dog on the front free trolley of the carrier.

SUMMARY OF THE INVENTION

The present invention provides an arrangement for transferring carriers free of the foregoing problems at a power line discontinuous portion of a power-and-free trolley conveyor.

The invention is characterized in that at a power line discontinuous portion of a power-and-free trolley conveyor between a carrier entering first power line and a second power line, a carrier is transferred from the first power line to the second by being pushed from behind by a following pusher dog on the first power line which is restrained from disengaging from the rear free trolley by at least one endless free chain positioned immediately above the path of the pusher dog. The endless free chain moves along with the engaged pusher dog thereby preventing wear on pusher dog side projection.

With the arrangement of this invention, the carrier can be properly transferred at the power line discontinuous portion by utilizing the propelling force of the following pusher dog, with the wear on the pusher dog side projection greatly reduced to render the arrangement serviceable for a prolonged period of time. Furthermore the present arrangement can be constructed without necessitating the cumbersome procedure conventionally needed for attaching a roller to the forward end of the side projection of every pusher dog and is therefore lower in material cost and very economical.

Additionally the arrangement is free of the drawback that the roller, if provided, would interfere with the disengagement of the pusher dog from the carrier tilting dog.

DESCRIPTION OF THE PREFERRED EMBODIMENT

Figure 1:
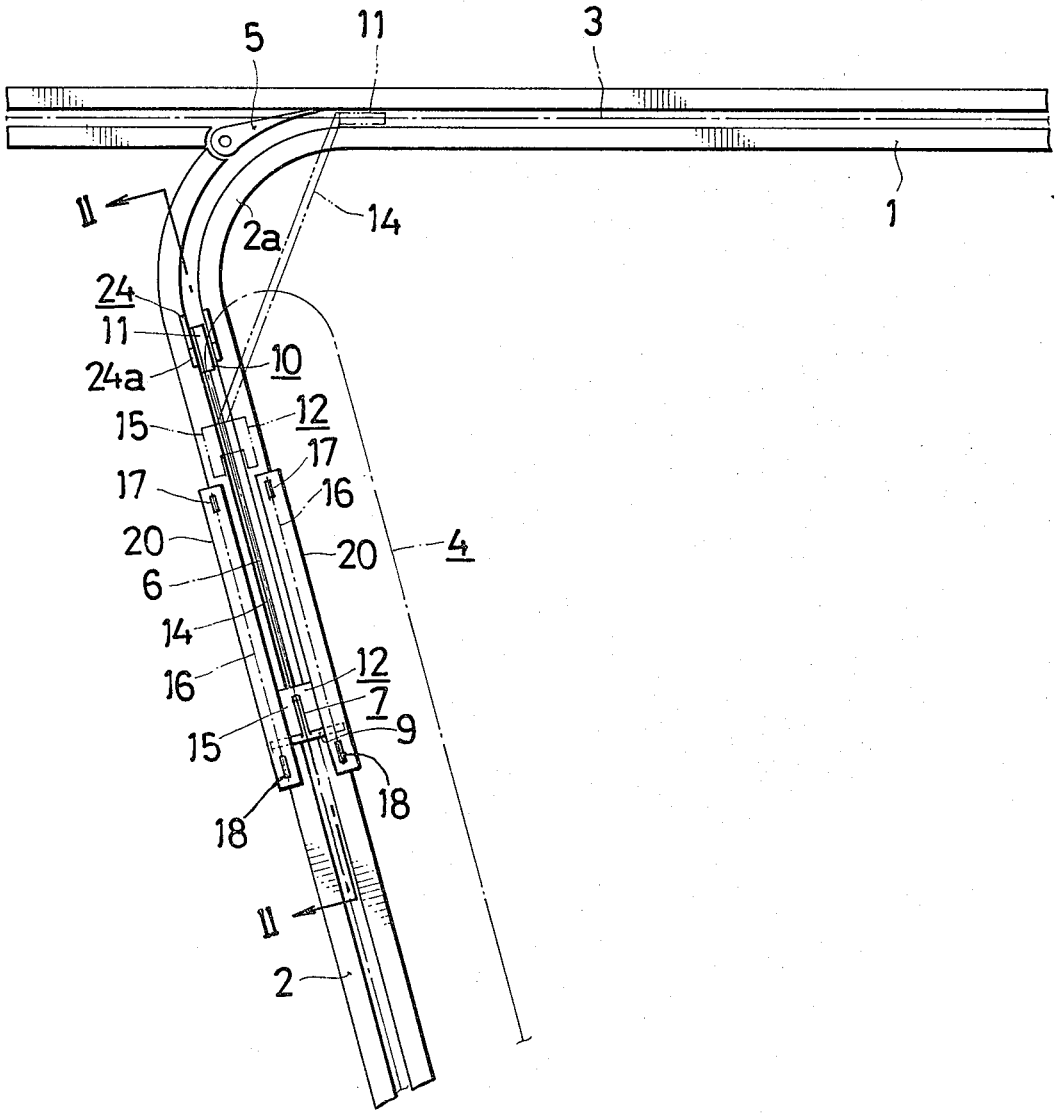
FIG. 1 is a plan view schematically showing a power-and-free trolley conveyor of this invention.
Figure 2:
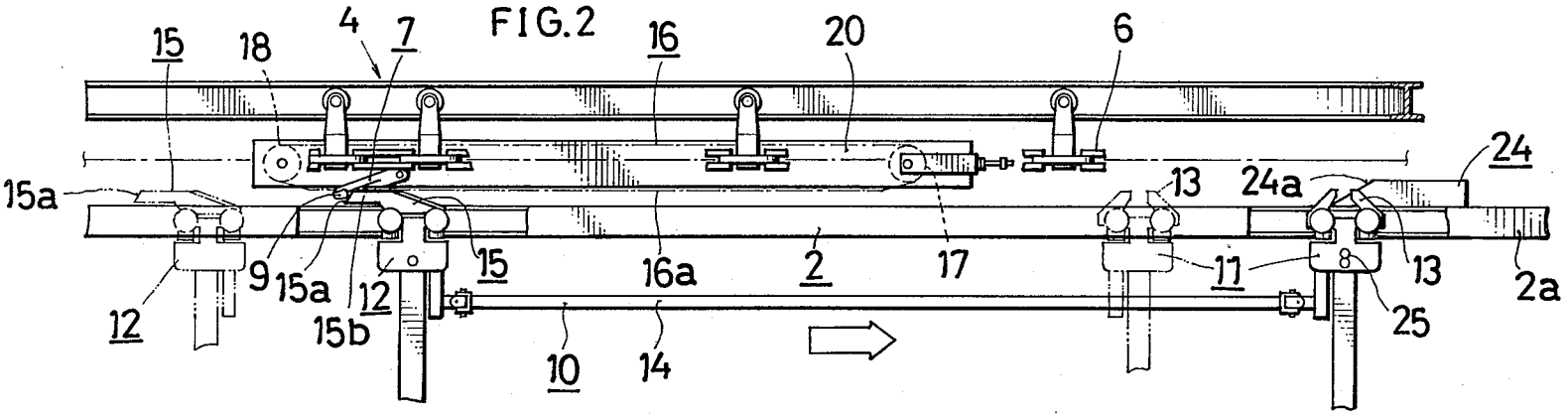
FIG. 2 is an enlarged side elevation of the same as it is seen along the line II—II in FIG. 1.
Figure 3:
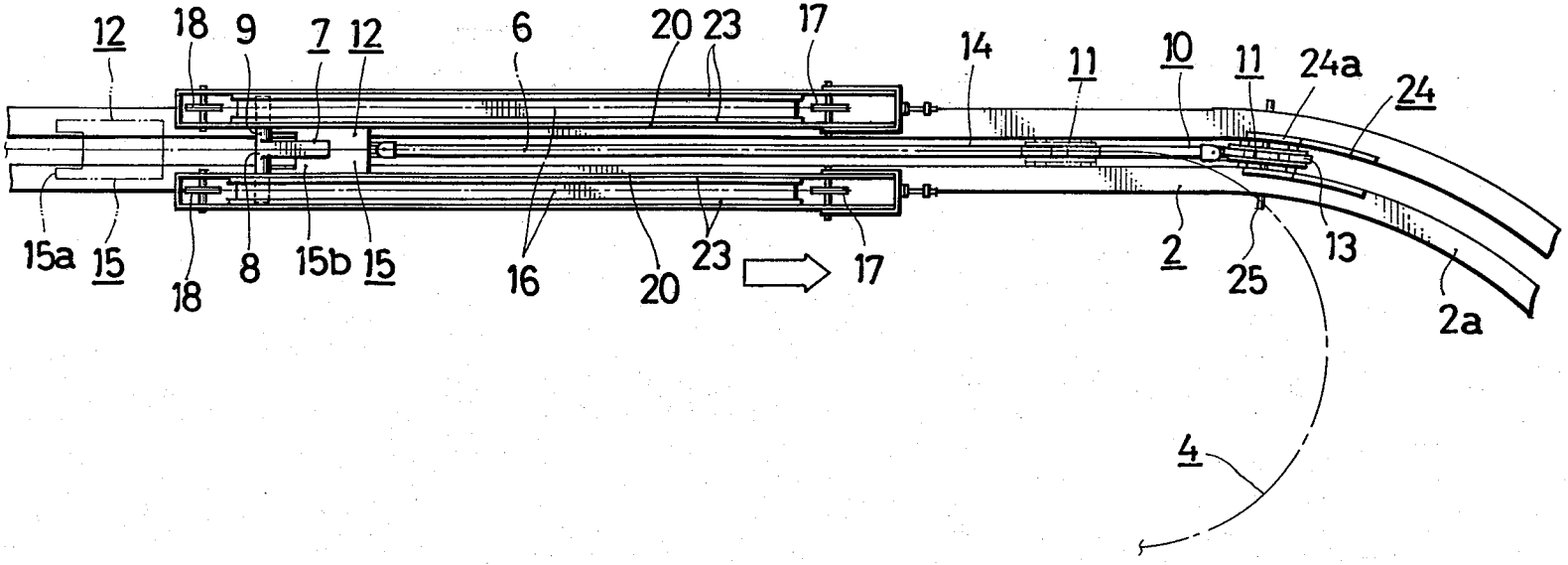
FIG. 3 is a fragmentary enlarged plan view corresponding to FIG. 2.
Figure 4:
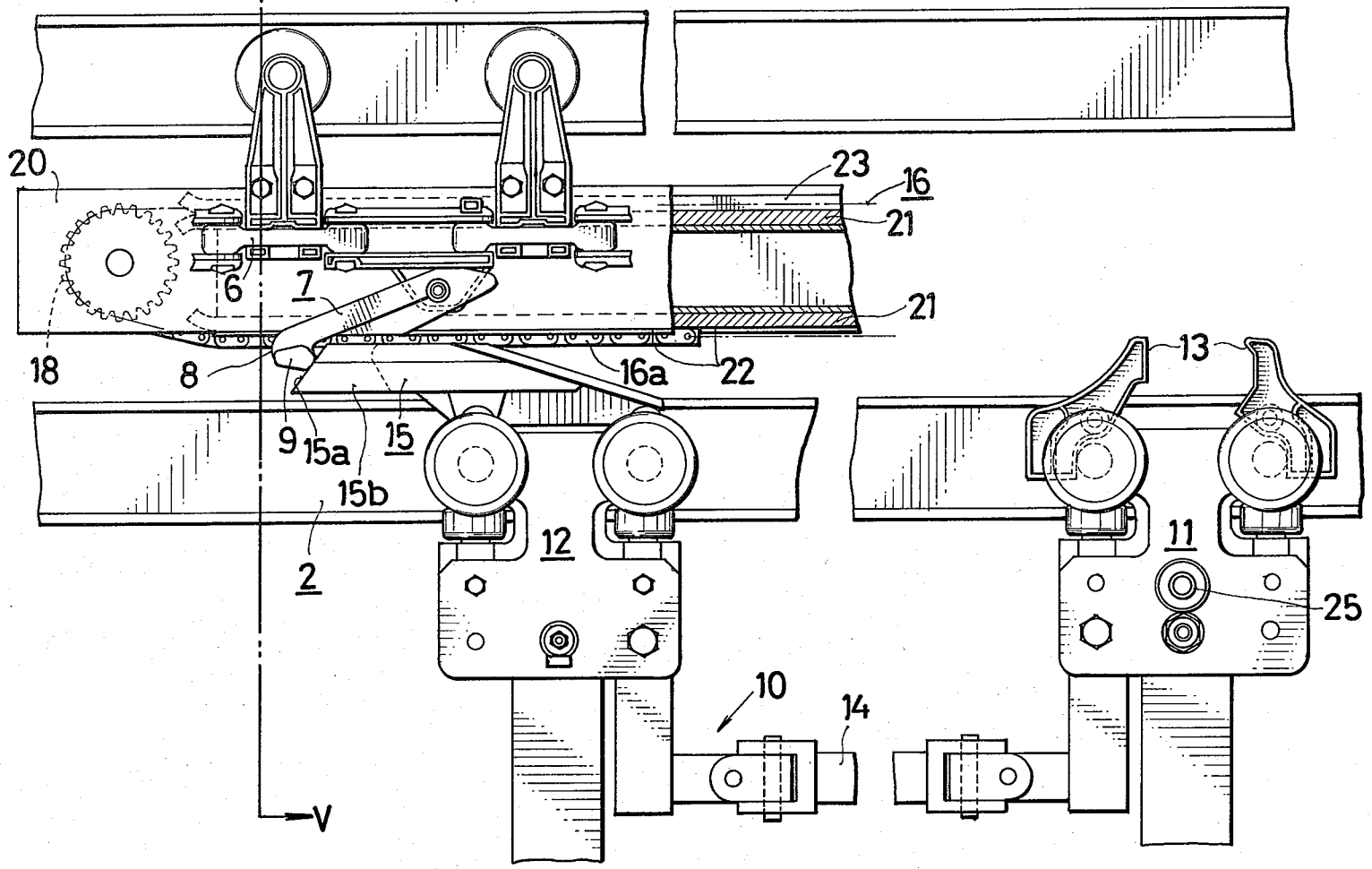
FIG. 4 is a fragmentary enlarged side elevation similar to FIG. 2 and partly broken away.
Figure 5:
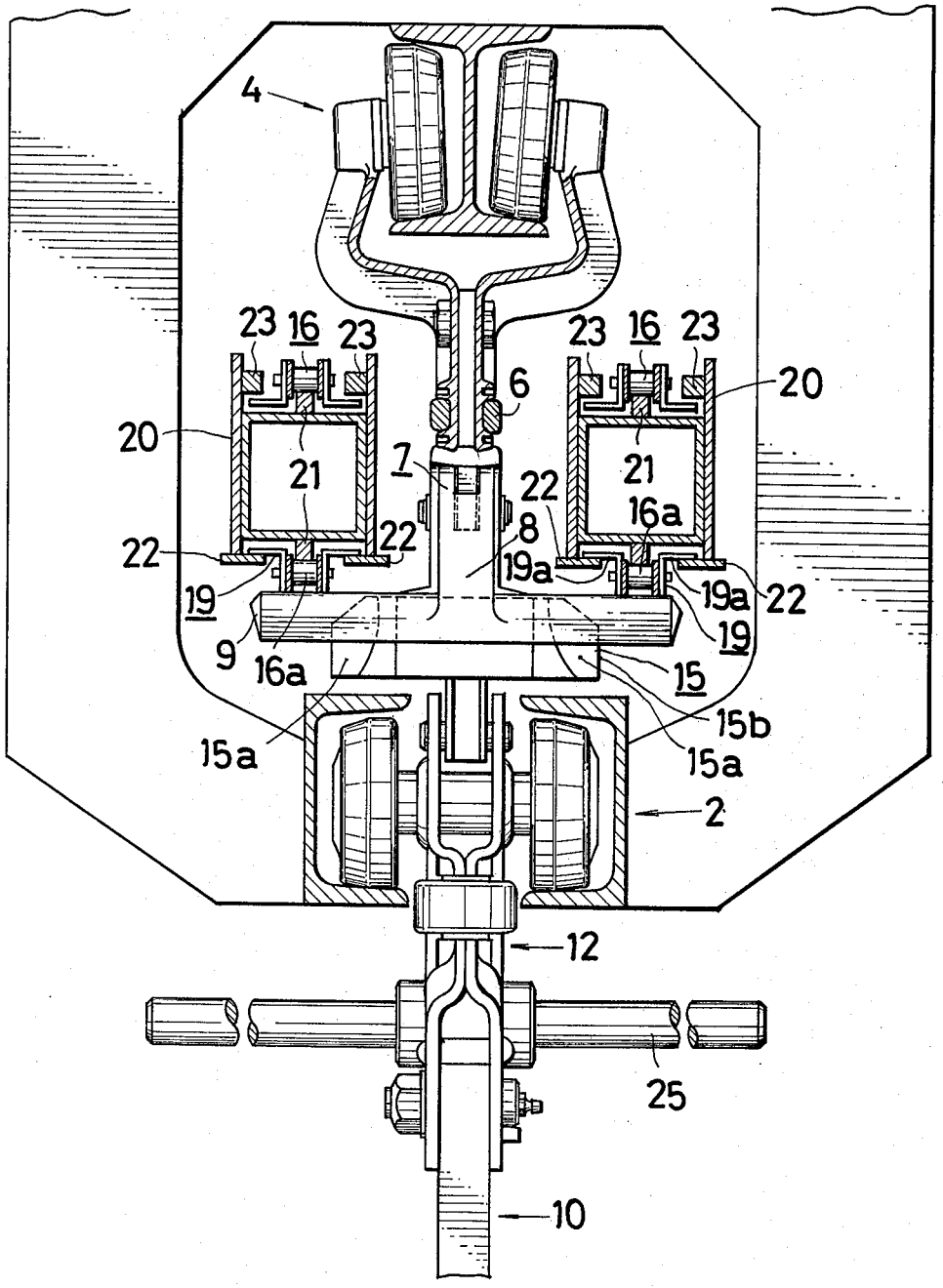
FIG. 5 is an enlarged view in section taken along the line V—V in FIG. 4.

With reference to the drawings, a first power line 3 extends along the upper side of a first free line 1 serving as the main line. On the other hand, a second power line 4 extends along the upper side of a second free line 2 serving as a branch line. The second power line 4 is turned back in the vicinity of the first free line 1, so that the first and second power lines 3 and 4 are arranged discontinuously as spaced apart from each other by a specified distance. The first and second free lines 1 and 2 are connected to each other by a free line connecting portion 2*a* which is circular arc when seen in a plan view. A switch bar 5 is provided at the junction of the free line connecting portion 2*a* and the first free line 1. The first and second power lines 3 and 4 each have a drive chain 6 to which a multiplicity of pusher dogs 7 are attached as spaced apart from one another by a predetermined distance. The pusher dog 7 is provided at its rear end with a hooked engaging portion 8 and side projections 9 extending from the portion 8 toward opposite sidewise directions. With its rear end down, the pusher dog is moved forward by the travel of the drive chain 6. Each of carriers 10 supported by the free lines 1 and 2 in suspension has a pair of free trolleys 11 and 12 at its front and rear ends, respectively. The front free trolley 11 has a tilting dog 13 with which the hooked engaging portion 8 of the pusher dog 7 is engageable. The opposite ends of a connecting bar 14 for interconnecting the front and rear free trolleys 11 and 12 are connected to these trolleys 11 and 12 pivotally movably in horizontal and vertical directions. The rear free trolley 12 has a cam 15 attached to its upper end and projecting rearward for accumulating following carriers 10. The cam 15 has at its rear end bifurcated legs 15*b* each formed at its rear end with a slope 15*a* inclined forwardly upward. The cam 15 is slightly smaller than the rail assembly of each of the free lines 1 and 2 in respect of width.

A pair of endless free chains 16 for restraining the pusher dog 7 are arranged at the opposite sides of the terminal end of the second power line 4. Each of the chains 16 is reeved around a pair of front and rear sprockets 17 and 18 and is movable around these sprockets. The lower side straight portion 16*a* of each chain 16 is positioned slightly above and in parallel to the path of movement of the corresponding side projection 9 on the pusher dog 7. The endless free chains 16 comprise outer links 19 which are L-shaped in cross section. Roller guides 21 for bearing the upper and lower straight portions of the endless free chain 16 are provided on the upper and lower sides of a frame 20 for supporting the chain, centrally of the width of the frame 20. Bearing portions 22 for supporting the outwardly extending horizontal portions 19*a* of the outer links 19 of the chain 16 are attached to the opposite sides of the lower portion of the support frame 20. Guides 23 for preventing the chain 16 from jolting upward and downward are attached to the opposite sides of the upper portion of the frame 20 in an inwardly projecting form. To the front and in the vicinity of the pair of endless free chains 16, pusher dog disengaging plates 24 are disposed at the opposite sides of the second free line 2. Each of the plates 24 is formed at its starting end with a guide slope 24*a* which is inclined forwardly upward. A pair of stoppers 25 extend outward from the opposite sides of the front free trolley 11. When the pusher dog 7 is disengaged from the tilting dog 13 of the carrier 10 on the conveyor line, these stoppers 25 serve to prevent the carrier 10 from being driven by inertia and stop the carrier.

The length of the lower side straight portion 16*a* of the pusher dog restraining chain 16, the length of the carrier 10 between the front and rear free trolleys 11, 12 and the length of the free line connecting portion 2*a* are predetermined as related to one another.

The arrangement of this invention described above operates in the following manner.

As a carrier 10 moves forward on the second free line 2 by being pulled by a pusher dog 7 on the second power line 4, the pusher dog 7 passes under the pair of endless free chains 16 and reaches the pair of pusher dog disengaging plates 24 in front of the chains 16. The side projections 9 on the opposite sides of the pusher dog 7 then ascend the guide slopes 24*a* of the disengaging plates 24, whereby the pusher dog 7 is disengaged from the tilting dog 13. Consequently the carrier 10 comes to a halt after running a small distance by virtue of inertia. At this time, the cam 15 on the rear free trolley 12 of the carrier 10 is positioned below the starting ends of the pair of endless free chains 16. Subsequently the following pusher dog 7 on the second power line 4 moves forward singly and reaches a location under the starting ends of the pair of free chains 16, whereupon the side projections 9 on the opposite sides of this pusher dog 7 come into striking contact with the rear end slopes 15*a* of the cam 15, acting to ascend the slopes 15*a*. However, the side projections 9 are restrained from ascending by the chains 16 and bear against the lower side straight portions 16*a* of the chains 16 from below. In this state, the pusher dog 7, the cam 15 on the carrier 10 and the pusher dog bearing portions of the chains 16 are moved forward together by the propelling force of the following pusher dog 7. When the front free trolley 11 of the carrier 10 has moved past the free line connecting portion 2*a* onto the first free line 1, the following pusher dog 7 is disengaged from the carrier cam 15. The front free trolley 11 is thereafter pulled along by a pusher dog 7 on the first power line 1 to transfer the whole carrier 10 onto the first free line 1.

In this way, the carrier 10 can be properly transferred at the power line discontinuous portion by the propelling force of the following pusher dog 7. Moreover, since the following pusher dog 7, the cam 15 of the carrier 10 and the pusher dog bearing portions of the endless free chains 16 move together when the carrier is pushed from behind for transfer, the wear of the side projections 9 of the pusher dog 7 can be reduced greatly.

While the illustrated embodiment is so adapted that the pusher dog 7 is forcibly disengaged from the tilting dog 13 on the carrier 10 by the pair of disengaging plates 24 disposed to the front of the endless free chains 16 close thereto, the pusher dog 7 may be made disengageable from the tilting dog 13 spontaneously, for example, by deviating the track of the second power line 4 from above the second free line 2 without installing such disengaging plates 24. Although the endless free chains 16 are arranged at the opposite sides of the terminal end of the second power line 4 for restraining the opposite side projections 9 at the rear end of the pusher dog 7, the dog 7 may have a side projection 9 extending therefrom toward at least one sidewise direction, so that only one endless free chain 16 may be provided alongside the second power line 4 on the same side as the side projection 9 for restraining the projection 9. Further although the carrier extending second free line 2 is connected as a branch to the first free line 1 serving as the main line, the carrier entering second free line 2 and the free line connecting portion having no power line may be arranged in alignment with the first free line 1, for example, when the first free line 1 provides a coating process for the articles to be conveyed.

The present invention may be embodied differently without departing from the spirit and basic features of the invention. Accordingly the embodiment herein disclosed is given for illustrative purposes only and is in no way limitative. It is to be understood that the scope of the invention is defined by the appended claim rather than by the specification and that various alterations and modifications within the definition and scope of the claims are included in the claim.

What is claimed is:

1. In a power-and-free trolley conveyor comprising first and second power lines (3), (4) arranged discontinuously as spaced apart from each other by a specified distance and each having a drive chain (6), first and second free lines (1), (2) arranged below the power lines (3), (4) respectively and connected to each other by a free line connecting portion (2*a*), carriers (10) suspended from the free lines (1), (2) and each having a front free trolley (11) and a rear free trolley (12), the front free trolley (11) being provided with a tilting dog (13), the rear free trolley (12) having a cam (15) attached to its upper end and projecting rearward for accumulating following carriers, the cam (15) being formed at its rear end with a slope (15*a*) inclined forwardly upward, and a plurality of pusher dogs (7) pivotably provided on the drive chain (6) of each of the power lines (3), (4) and arranged at a specified spacing, each of the pusher dogs (7) being provided at its rear end with a hooked engaging portion (8) and a side projection (9) extending from the engaging portion in at least one sidewise direction, an arrangement for transferring the carriers at the power line discontinuous portion comprising an endless free chain (16) disposed at least at one side of the terminal end of the second power line (4) for restraining the pusher dog (7), the endless free chain (16) having a lower side straight portion (16*a*) positioned slightly above and in parallel to the path of movement of the side projection (9) on the pusher dog (7), the length of the lower side straight portion (16*a*) of the endless free chain (16), the length of the carrier (10) between the front and rear trolleys (11),

(12) and the length of the free line connecting portion (2*a* ) being predetermined as related to one another, so that when one pusher dog (7) in engagement with the tilting dog (13) on the front free trolley (11) of a carrier (10) on the second free line (2) to pull along the carrier is disengaged from the tilting dog at a location beyond the terminal end of the endless free chain (16), the cam (15) on the rear free trolley (12) of the same carrier (10) is positioned at the starting end of the endless free chain (16), permitting the following pusher dog (7) to come into striking contact with the rear end slope (15*a*) of the cam (15) and the side projection (9) of the following pusher dog (7) to bear against the lower side straight portion (16*a*) of the endless free chain (16) from therebelow, to cause the propelling force of the following pusher dog (7) to move together the following pusher dog (7), the cam (15) on the carrier (10) and the pusher dog bearing portion of the endless free chain (16), the following pusher dog (7) being thereafter disengageable from the cam (15) on the carrier (10) when the front free trolley (11) of the carrier (10) has moved past the free line connecting portion (2*a* ) onto the first free line (1).

* * * * *